US008706001B2

(12) United States Patent
Yamauchi et al.

(10) Patent No.: US 8,706,001 B2
(45) Date of Patent: Apr. 22, 2014

(54) IMAGE FORMING APPARATUS WITH RESIN FRAME AND METHOD FOR MOLDING THE RESIN FRAME

(75) Inventors: Kohichi Yamauchi, Osaka (JP); Shinichi Takeda, Osaka (JP); Norio Tomita, Osaka (JP); Shinji Nakazawa, Osaka (JP); Noriaki Taguchi, Osaka (JP); Kenichi Isomi, Osaka (JP); Shuichi Mochizuki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 211 days.

(21) Appl. No.: 13/083,837

(22) Filed: Apr. 11, 2011

(65) Prior Publication Data

US 2011/0280614 A1 Nov. 17, 2011

(30) Foreign Application Priority Data

May 11, 2010 (JP) ..... 2010-109516

(51) Int. Cl.
*G03G 15/00* (2006.01)
*G03G 21/16* (2006.01)
*G03G 15/01* (2006.01)

(52) U.S. Cl.
CPC ..... *G03G 21/1619* (2013.01); *G03G 15/0142* (2013.01); *G03G 2221/1603* (2013.01); *G03G 2221/1678* (2013.01)
USPC ..... 399/107; 24/328.1

(58) Field of Classification Search
CPC ..... G03G 15/0142; G03G 21/1619; G03G 2221/1603; G03G 2221/1678
USPC ..... 399/107, 110
See application file for complete search history.

(56) References Cited

U.S. PATENT DOCUMENTS

| | | | | | |
|---|---|---|---|---|---|
| 4,996,566 | A * | 2/1991 | Morita et al. | ..... | 399/28 |
| 6,019,929 | A * | 2/2000 | Noggle et al. | ..... | 264/297.2 |
| 6,069,646 | A | 5/2000 | Okabe et al. | ..... | 347/257 |
| 6,463,231 | B2 | 10/2002 | Numazu et al. | ..... | 399/110 |

(Continued)

FOREIGN PATENT DOCUMENTS

| | | | | |
|---|---|---|---|---|
| JP | 62-050772 | | 3/1987 | |
| JP | 62050771 | A * | 3/1987 | ..... G03G 15/00 |
| JP | 7-132665 | | 5/1995 | |
| JP | 2001-281952 | A | 10/2001 | |

(Continued)

*Primary Examiner* — David Gray
*Assistant Examiner* — Thomas Giampaolo, II
(74) *Attorney, Agent, or Firm* — Renner, Otto, Boisselle & Sklar, LLP

(57) ABSTRACT

An image forming apparatus of the present invention includes a resin frame composed of a resin and an image forming unit that is removably inserted in the resin frame. The resin frame includes a base having a supporting surface that supports the image forming unit, a guide portion that extends in the base in an insertion direction in which the image forming unit is inserted along the supporting surface and that guides the image forming unit in the insertion direction while limiting movement of the image forming unit in an orthogonal direction that is orthogonal to the insertion direction, and a side plate portion that is provided at a peripheral edge of the base so as to extend in a direction perpendicular to the supporting surface, the base, the guide portion, and the side plate portion being integrally molded from a resin. A mold opening direction of a mold for molding the guide portion is set to a direction parallel to the orthogonal direction, and downstream end portions of the side plate portion in the mold opening direction are integrally connected to each other and extend essentially parallel to the perimeter of the base.

11 Claims, 10 Drawing Sheets

(56) References Cited

U.S. PATENT DOCUMENTS

| | | | | |
|---|---|---|---|---|
| 2001/0051059 | A1* | 12/2001 | Morikami et al. | 399/121 |
| 2008/0075502 | A1* | 3/2008 | Tada et al. | 399/111 |
| 2010/0080624 | A1 | 4/2010 | Matsuda | |

FOREIGN PATENT DOCUMENTS

| | | |
|---|---|---|
| JP | 2003-167490 | 6/2003 |
| JP | 2006-239876 | 9/2006 |
| JP | 2010-102297 | 5/2010 |

* cited by examiner

IMAGE FORMING APPARATUS WITH RESIN FRAME AND METHOD FOR MOLDING THE RESIN FRAME

CROSS-REFERENCE TO RELATED APPLICATIONS

This application claims priority under 35 U.S.C. §119(a) on Patent Application No. 2010-109516 filed in Japan on May 11, 2010, the entire contents of which are herein incorporated by reference.

BACKGROUND OF THE INVENTION

Conventionally, frames serving as the frameworks of image forming apparatuses such as copiers, printers, facsimile machines, or digital multifunctional machines have been metal frame structures assembled by fastening or welding metal pressed components or metal-based steel products together.

With the recent trend toward lower costs for image forming apparatuses, conventional metal frames are not sufficiently profitable. Moreover, with the trend toward smaller and lighter apparatuses, simplification of the structure, reduction in the number of components, and the like have been pursued, but the metal frame structures impose a limit on the reduction in size and weight.

In view of the reduction in cost, size, and weight for the frame structure, it is conceivable to employ a resin frame composed of a resin. However, in this case, there is a problem with regard to the strength.

On the other hand, in an image forming apparatus including image forming units (processing units) such as a photosensitive member's unit, a charging unit, and a development unit, a guide portion extending in an insertion direction of the image forming units may be provided in order to guide the image forming units during insertion into and removal from a main body of the image forming apparatus.

For example, JP 2001-281952A discloses that a unit mounted portion has rail portions serving as guide portions during insertion of a drum set on a drum set attachment/detachment side and rail portions serving as guide portions during insertion of a toner set on a toner set attachment/detachment side.

In the case where a resin frame is molded using a mold, in order to mold a guide portion that is formed so as to extend in the insertion direction of an image forming unit, when a mold opening direction of a mold for molding the guide portion is set to a direction parallel to the insertion direction of the image forming unit, problems as described below may arise.

That is to say, in the case of forming the guide portion so as to extend in the insertion direction of the image forming unit, the distance over which the mold slides with respect to the guide portion increases, leaving problems in producing the mold in terms of the structure of the mold, the cost of the mold, and the like.

Moreover, in the case of setting the mold opening direction of the mold to the direction parallel to the insertion direction of the image forming unit, there may be problems with the position accuracy or the ease of operation of the image forming unit because of the draft of the mold.

FIG. 10 is a perspective view showing a pair of rail portions (guide portions) G1, G2 formed by setting the mold opening direction of the mold to a direction parallel to the insertion direction in which the image forming unit is inserted.

As shown in FIG. 10, the draft angle θ of the mold is set to, for example, about 3° because a certain amount of slide travel for molding a guide portion during removal of the mold is required. In that case, a distance d1 between upstream end portions of the pair of guide portions G1, G2 in an insertion direction Y1 of an image forming unit F is larger than a distance d2 between downstream end portions of the pair of guide portions G1, G2, and so a gap Δd is created at the upstream end portions of the pair of guide portions G1, G2 between the pair of guide portions G1, G2 and the image forming unit F, resulting in a decrease in the position accuracy of the image forming unit F. This becomes more conspicuous as the amount of slide travel for molding the guide portion increases.

In addition, once the gap Δd is created at the upstream end portions of the pair of guide portions G1, G2 between the pair of guide portions G1, G 2 and the image forming unit F, during insertion of the image forming unit F, the image forming unit F tends to skew with respect to the pair of guide portions G1, G2, and thus a sliding portion F1 tends to get caught by the pair of guide portions G1, G2 in the course of insertion of the image forming unit F.

SUMMARY OF THE INVENTION

Thus, it is a problem underlying the present invention to provide an image forming apparatus including a resin frame composed of a resin and an image forming unit that is removably inserted in the resin frame and a method for molding a resin frame, the image forming apparatus and the resin frame molding method being capable of simplifying the structure of a mold while securing the strength of the resin frame, and also suppressing decreases in the position accuracy and in the ease of operation of the image forming unit.

In order to solve the problem, the present invention provides an image forming apparatus including a resin frame composed of a resin and an image forming unit that is removably inserted into the resin frame, wherein the resin frame includes a base having a supporting surface that supports the image forming unit, a guide portion that extends in the base in an insertion direction in which the image forming unit is inserted along the supporting surface and that guides the image forming unit in the insertion direction while limiting movement of the image forming unit in an orthogonal direction that is orthogonal to the insertion direction, and a side plate portion that is provided at a peripheral edge of the base so as to extend in a direction perpendicular to the supporting surface, the base, the guide portion, and the side plate portion being integrally molded from a resin, a mold opening direction of a mold for molding the guide portion being set to a direction parallel to the orthogonal direction, and downstream end portions of the side plate portion in the mold opening direction being integrally connected to each other and extending essentially parallel to a perimeter of the base.

Moreover, the present invention also provides a resin frame molding method for molding a frame of an image forming apparatus including an image forming unit that is removably inserted in the frame from a resin, the method including a molding step of integrally molding a base having a supporting surface that supports the image forming unit, a guide portion that extends in the base in an insertion direction in which the image forming unit is inserted along the supporting surface and that guides the image forming unit in the insertion direction while limiting movement of the image forming unit in an orthogonal direction that is orthogonal to the insertion direction, and a side plate portion that is provided at a peripheral edge of the base so as to extend in a direction perpendicular to the supporting surface, wherein in the molding step, a mold opening direction of a mold for molding the guide portion is set to a direction parallel to the orthogonal direction, and during molding of the side plate portion, downstream end portions of the side plate portion in the mold opening direction are integrally connected to each other and extend essentially parallel to a perimeter of the base.

According to the image forming apparatus and the resin frame molding method of the present invention, since the downstream end portions, in the mold opening direction, of the side plate portion, which is provided at the peripheral edge of the base so as to extend in the direction perpendicular to the supporting surface, are integrally connected to each other and extend essentially parallel to the perimeter of the base, the strength of the resin frame can be secured. In addition, since the mold opening direction of the mold for molding the guide portion is set to the direction parallel to the orthogonal direction that is orthogonal to the insertion direction and the guide portion is molded in the direction parallel to the orthogonal direction, the distance over which the mold slides with respect to the guide portion can be reduced, and thus the structure of the mold can be simplified. Furthermore, since the mold opening direction of the mold for molding the guide portion is set to the direction parallel to the orthogonal direction and the draft of the mold is unrelated to the direction parallel to the insertion direction in which the image forming unit is inserted, a decrease in the position accuracy of the image forming unit in the orthogonal direction can be suppressed, the image forming unit can be inserted smoothly, and thus a decrease in the ease of operation of the image forming unit can be suppressed.

According to an exemplary aspect of the image forming apparatus of the present invention, an extended guide portion extending further upstream from an upstream end portion of the guide portion in the insertion direction in which the image forming unit is inserted is integrally molded with the guide portion, and the mold opening direction of a mold for molding the extended guide portion is set to a direction parallel to the insertion direction. Moreover, according to an exemplary aspect of the resin frame molding method of the present invention, in the molding step, the guide portion and an extended guide portion extending further upstream from an upstream end portion of the guide portion in the insertion direction in which the image forming unit is inserted are integrally molded, and the mold opening direction of a mold for molding the extended guide portion is set to a direction parallel to the insertion direction.

According to the above-described matters specifying the invention, a portion (for example, a portion corresponding to the side plate portion) of the guide portion that is difficult to mold using the mold whose mold opening direction in the base is set to the direction parallel to the orthogonal direction can be molded as the extended guide portion using the mold whose mold opening direction is set to the direction parallel to the insertion direction.

According to an exemplary aspect of the image forming apparatus of the present invention, the resin frame is H-shaped in cross section with the base provided between an upper end portion and a lower end portion of the resin frame in a vertical direction and perpendicular to the side plate portion. Moreover, according to an exemplary aspect of the resin frame molding method of the present invention, in the molding step, a resin frame that is H-shaped in cross section with the base provided between an upper end portion and a lower end portion of the resin frame and perpendicular to the side plate portion is molded.

According to the above-described matters specifying the invention, the resin frame is formed into an H shape, which provides excellent rigidity while realizing an improvement in the section efficiency, and this makes it possible to improve the overall strength of the resin frame with a simple structure and, furthermore, to provide the base, which supports the image forming unit, in a position between the upper end portion and the lower end portion of the resin frame in the vertical direction at which the strength is increased.

According to an exemplary aspect of the present invention, the image forming unit includes a photosensitive member's unit, a charging unit, a cleaning unit, and a development unit. The image forming unit may be a unit into which at least two of the photosensitive member's unit, the charging unit, the cleaning unit, and the development unit are combined. In this case, the at least two units may be an integral unit.

According to the above-described matters specifying the invention, among the photosensitive member's unit, the charging unit, and the development unit whose position accuracy is likely to influence the image quality, a decrease in the position accuracy of a unit that is supported by the base can be suppressed, and the image quality can be improved accordingly.

According to an exemplary aspect of the present invention, the image forming unit is a color image forming unit.

According to the above-described matter specifying the invention, a decrease in the position accuracy of the color image forming unit can be suppressed, and the color image quality can be improved accordingly.

DESCRIPTION OF THE PREFERRED EMBODIMENTS

Hereinafter, an embodiment according to the present invention will be described with reference to the drawings. It should be noted that the embodiment described below is an example embodying the present invention and should not be construed as limiting the technical scope of the present invention.

Description of Overall Configuration of Image Forming Apparatus

Figure 1:
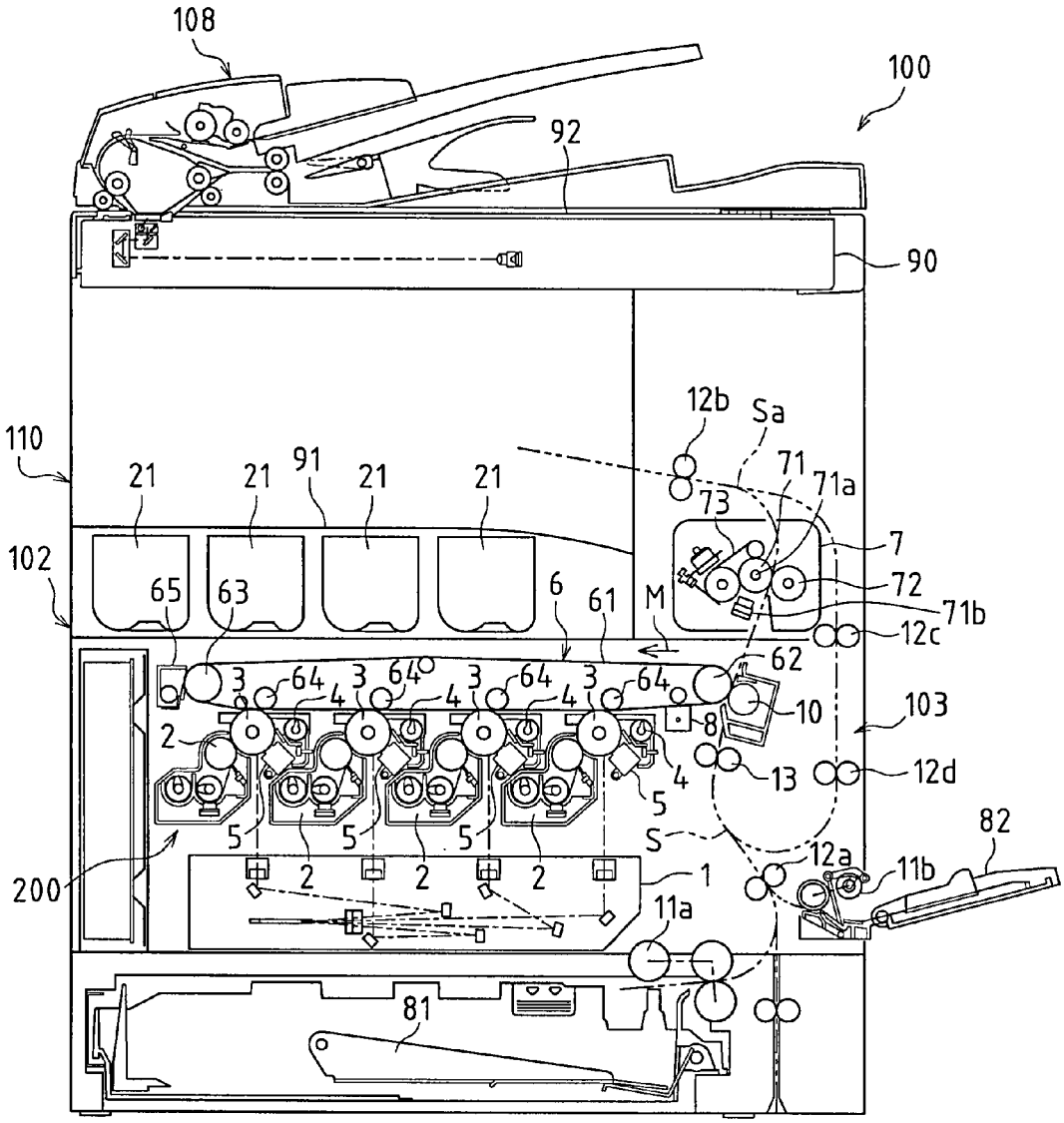
FIG. 1 is a schematic cross-sectional view of an image forming apparatus according to an embodiment of the present invention as seen from the front.

FIG. 1 is a schematic cross-sectional view of an image forming apparatus 100 according to the present embodiment as seen from the front.

The image forming apparatus 100 shown in FIG. 1 is a color image forming apparatus that forms images in multiple colors or in a single color on sheets of recording paper or the like (hereinafter referred to as "recording paper") in accordance with image data transmitted from outside. The image forming apparatus 100 includes an original reading apparatus 108 and an apparatus main body 110, and the apparatus main body 110 is provided with an image forming portion 102 and a paper transport system 103.

The image forming portion 102 includes an exposure unit 1, a plurality of development units 2, a plurality of photosensitive member units 4, an intermediate transfer belt unit 6, a pre-transfer charge unit 8, a plurality of toner cartridge units 21, and a fixing unit 7. In the present embodiment, the exposure unit 1, the development units 22, the photosensitive member units 4, the intermediate transfer belt unit 6, and the toner cartridge units 21 act as a plurality of removable image forming units 200 that perform different image forming operations. It should be noted that the photosensitive member units 4 are herein regarded as units in each of which a photosensitive member's unit and a charging unit and a cleaning unit are integrally combined.

Moreover, the paper transport system 103 includes a paper feed tray 81, a manual paper feed tray 82, and a paper discharge tray 91.

An original platen 92 composed of a transparent glass on which an original (a sheet) can be placed is provided in an upper portion of the apparatus main body 110, and an optical unit 90 for reading the original is provided below the original platen 92. Moreover, the original reading apparatus 108 is provided above the original platen 92. The original reading apparatus 108 automatically transports the original onto the original platen 92. Moreover, the original reading apparatus 108 is pivotably attached to the apparatus main body 110 so that a front side thereof can be opened, and it is possible to manually place the original there by uncovering an upper surface of the original platen 92. It should be noted that in the present embodiment, the front side of the apparatus main body 110 is regarded as an attachment/detachment side from which the toner cartridge units 21, the photosensitive member units 4, the development units 2, and the pre-transfer charge unit 8 can be attached/detached.

The original reading apparatus 108 can read originals that are automatically transported or originals that have been placed on the original platen 92. An entire image of an original that has been read by the original reading apparatus 108 is sent to the apparatus main body 110 of the image forming apparatus 100 as image data. Then, in the apparatus main body 110, an image is formed based on the image data and recorded on recording paper.

The image data handled in the image forming apparatus 100 corresponds to a color image using a plurality of colors (here, the colors of black (K), cyan (C), magenta (M), and yellow (Y)). Therefore, more than one (here, four, respectively corresponding to black, cyan, magenta, and yellow) of the development units 2, the photosensitive member units 4, and the toner cartridge units 21 are provided, so that a plurality of types (here, four types) of images corresponding to individual colors are formed, and these units constitute a plurality of (here, four) image stations.

In the photosensitive member units 4, charging devices 5 serve as charging means for uniformly charging the surface of photosensitive drums 3 at a predetermined electric potential. In addition to a charger-type charging device as shown in FIG. 1, a roller-type charging device or a brush-type charging device, which are of a contact-type, can be used.

The exposure unit 1 is configured as a laser scanning unit (LSU) including a laser emitting portion and a reflection mirror. The exposure unit 1 is provided with a polygon mirror that scans a laser beam and optical elements, such as a lens and a mirror, for guiding laser light that has been reflected by this polygon mirror to the photosensitive drums 3. Moreover, concerning the exposure unit 1, other techniques can also be adopted in which, for example, EL (electroluminescence) or a write head having an array of light emitting elements such as LEDs (light emitting diodes) is used.

The exposure unit 1 exposes each of the charged photosensitive drums 3 in accordance with the image data that has been input, thereby forming electrostatic latent images corresponding to the image data on the surfaces of the respective photosensitive drums 3.

The toner cartridge units 21 are units that accommodate toners, and are adapted to supply the toners to development baths of the development units 2. In the apparatus main body 110 of the image forming apparatus 100, the toners supplied from the toner cartridge units 21 to the development baths of the development units 2 are controlled so as to keep the toner concentrations in developers in the development baths constant.

The development units 2 make the electrostatic latent images formed on the respective photosensitive drums 3 visible using the four colors (Y, M, C, and K) of toners. Moreover, the photosensitive member units 4 also have a cleaning function of removing and collecting residual toner on the surfaces of the photosensitive drums 3 after developing and transferring the images.

The intermediate transfer belt unit 6 disposed above the photosensitive drums 3 includes an intermediate transfer belt 61 that acts as an intermediate transfer member, an intermediate transfer belt drive roller 62, an intermediate transfer belt idler roller 63, a plurality of intermediate transfer rollers 64, and an intermediate transfer belt cleaning unit 65.

Four rollers are provided as the intermediate transfer rollers 64 for the colors Y, M, C, and K, respectively. The intermediate transfer belt drive roller 62, together with the intermediate transfer belt idler roller 63 and the intermediate transfer rollers 64, stretches the intermediate transfer belt 61, and when the drive roller is driven to rotate, the intermediate transfer belt 61 is moved around in a moving direction (the direction of arrow M in FIG. 1), and with this movement, the idler roller 63 and the intermediate transfer rollers 64 are idly rotated.

A transfer bias for transferring the toner images formed on the photosensitive drums 3 onto the intermediate transfer belt 61 is applied to each of the intermediate transfer rollers 64.

The intermediate transfer belt 61 is provided in contact with the photosensitive drums 3. The toner images that have been formed on the photosensitive drums 3 in respective colors are sequentially transferred onto the intermediate transfer belt 61 in such a manner that the toner images are superimposed on top of one another, and thus, a color toner image (a multi-color toner image) is formed on the surface of the belt. The intermediate transfer belt 61 is, for example, an endless belt composed of a film having a thickness of approximately 100 μm to 150 μm.

Transfer of the toner images from the photosensitive drums 3 to the intermediate transfer belt 61 is performed by the intermediate transfer rollers 64 that are in contact with a back side of the intermediate transfer belt 61. For transfer of the toner images, a high-voltage transfer bias (a high voltage with the opposite polarity (+) to the charge polarity (−) of the toners) is applied to the intermediate transfer rollers 64. The intermediate transfer rollers 64 are rollers in which a metal (stainless steel, for example) shaft having a diameter of 8 mm to 10 mm is used as a base and the surface of the shaft is covered with a conductive elastic material (for example, a resin material such as EPDM (ethylene-propylene-diene rubber) or urethane foam). With this conductive elastic material, the intermediate transfer rollers 64 serve as transfer electrodes that uniformly apply a high voltage to the intermediate transfer belt 61. In the present embodiment, roller-shaped transfer electrodes are used as the transfer electrodes. However, it is also possible to use other types of transfer electrodes such as brush-shaped transfer electrodes.

As described above, the toner images that have been made visible in respective hues on the photosensitive drums 3 are layered on top of one another on the intermediate transfer belt 61. Due to the revolving movement of the intermediate transfer belt 61, the layered toner images on the intermediate transfer belt 61 are transferred onto the recording paper by a transfer roller 10 constituting a secondary transfer mechanism portion that is disposed at a position where the recording paper and the intermediate transfer belt 61 come into contact with each other. However, the configuration of the secondary transfer mechanism portion is not limited to the transfer roller, and a transfer configuration such as a corona charger or a transfer belt can be used as well.

At this time, a voltage (a high voltage with the opposite polarity (+) to the charge polarity (−) of the toners) for transferring the toners onto the recording paper is applied to the transfer roller 10 in a state in which a transfer nip is formed between the roller and the intermediate transfer belt 61. The transfer nip is formed between the transfer roller 10 and the intermediate transfer belt drive roller 62 by the transfer roller 10 and the intermediate transfer belt 61 pressing against each other. In order to constantly obtain the transfer nip, either one of the transfer roller 10 and the intermediate transfer belt drive roller 62 is configured as a hard roller composed of a hard material (such as a metal), and the other roller is configured as an elastic roller composed of a soft material (a resin material such as elastic rubber or foam resin).

During transfer of the toner images on the intermediate transfer belt 61 onto the recording paper by the transfer roller 10, there are cases where the toners are not completely transferred onto the recording paper, leaving residual toner on the intermediate transfer belt 61. The residual toner on the intermediate transfer belt 61 may cause mixing of the color toners in the following processing. For this reason, the residual toner on the intermediate transfer belt 61 is removed and collected by the intermediate transfer belt cleaning unit 65. Specifically, the intermediate transfer belt cleaning unit 65 is provided with a cleaning member (a cleaning blade, for example) that is in contact with the intermediate transfer belt 61. The idler roller 63 supports the intermediate transfer belt 61 from an inner side (the back side), and the cleaning member is in contact with the intermediate transfer belt 61 in such a manner that the cleaning member presses the belt against the idler roller 63 from an outer side.

The pre-transfer charge unit 8 here has a pre-transfer charger (PCT) and is provided in the vicinity of the intermediate transfer belt 61 located at a position upstream of the transfer nip between the transfer roller 10 and the intermediate transfer belt 61 and downstream of the photosensitive member units 4 in the moving direction M of the intermediate transfer belt 61.

Incidentally, there are cases where variations occur in the charge amount of the toner images on the intermediate transfer belt 61 that have been transferred from the photosensitive drums 3 because the toner images may include a halftone portion or a solid portion or may include portions having different amounts of superimposed toners. Moreover, due to a separating discharge that occurs in a gap adjacent to and downstream of a primary transfer portion in the moving direction M of the intermediate transfer belt 61, there are cases where variations occur in the charge amount within a toner image on the intermediate transfer belt 61 after primary transfer. Such variations in the charge amount within the same toner image decrease the transfer margin during transfer of the toner image on the intermediate transfer belt 61 onto a sheet.

Thus, the pre-transfer charge unit 8 is used to uniformly charge the toner image prior to transfer onto the sheet, and this makes it possible to eliminate variations in the charge amount within the same toner image and improve the transfer margin during secondary transfer.

The paper feed tray 81 is a tray for storing beforehand recording paper onto which an image is to be formed (printed), and is provided below the exposure unit 1 in the apparatus main body 110. Moreover, recording paper onto which an image is to be formed (printed) is placed in the manual paper feed tray 82. The paper discharge tray 91 is provided above the image forming portion 102 in the apparatus main body 110, and recording paper on which an image has been formed (printed) is accumulated facedown in this tray.

Moreover, the apparatus main body 110 is provided with a paper transport path S for conveying recording paper fed from the paper feed tray 81 and the manual paper feed tray 82 to the paper discharge tray 91 via the transfer roller 10 and the fixing unit 7. Pickup rollers 11*a* and 11*b*, a plurality of transport rollers 12*a* to 12*d*, registration rollers 13, the transfer roller 10, and a heat roller 71 and a pressure roller 72 of the fixing unit 7 are disposed in the vicinity of the paper transport path S.

The transport rollers 12*a* to 12*d* are small rollers for promoting and assisting transport of recording paper and are provided along the paper transport path S. Moreover, the pickup roller 11*a* is provided in the vicinity of a paper supply side of the paper feed tray 81 and picks up and supplies pieces of recording paper one-by-one from the paper feed tray 81 to the paper transport path S. Similarly, the pickup roller 11*b* is provided in the vicinity of a paper supply side of the manual paper feed tray 82 and picks up and supplies pieces of recording paper one-by-one from the manual paper feed tray 82 to the paper transport path S.

Moreover, the registration rollers 13 temporarily hold recording paper during transport through the paper transport path S. Then, the registration rollers 13 transport the recording paper to the transfer roller 10 at the timing when a leading end of a toner image on the photosensitive drums 3 and a leading end of the recording paper are aligned.

The fixing unit 7 is for fixing an unfixed toner image onto the recording paper and includes the heat roller 71 and the pressure roller 72, which act as fixing rollers. The heat roller 71, when driven to rotate, transports the recording paper in conjunction with the idly rotated pressure roller 72 while sandwiching the recording paper between each other. Moreover, the heat roller 71 is heated by a heater 71*a* provided inside and is maintained at a predetermined fixing temperature based on a signal from a temperature detector 71*b*. The heat roller 71 heated by the heater 71*a*, in conjunction with the pressure roller 72, bonds a multi-color toner image that has been transferred onto the recording paper to the recording paper by heat and pressure, whereby the multi-color toner image is fused, mixed, pressed against the recording paper, and thus fixed to the recording paper by heat. Moreover, the fixing unit 7 is provided with an external heating belt 73 for heating the heat roller 71 from outside.

In the image forming apparatus 100 having the above-described configuration, in the case where single-sided printing onto the recording paper is required, the recording paper supplied from the paper feed tray 81 or 82 is transported to the registration rollers 13 by the transport rollers 12*a* provided along the paper transport path S, then transported by the transfer roller 10 at the timing when the leading end of the recording paper and the leading end of the toner image on the intermediate transfer belt 61 are aligned, and then the toner image is transferred onto the recording paper. Afterward, the recording paper passes through the fixing unit 7, where the unfixed toners on the recording paper are fused and fixed by heat, and subsequently the recording paper is discharged onto the paper discharge tray 91 via the transport rollers 12*b*.

Moreover, in the case where double-sided printing onto the recording paper is required, after the above-described single-sided printing has been finished, the transport rollers 12*b* are rotated in reverse in a state in which a rear end of the recording paper that has passed through the fixing unit 7 is located between the last transport rollers 12*b* and a branch portion Sa of the paper transport path S, so that the recording paper is guided to the transport rollers 12*c* and 12*d*. Then, the recording paper is transported to the transfer nip via the registration rollers 13, where a back surface of the recording paper is printed, and subsequently the recording paper is discharged to the paper discharge tray 91.

Regarding the Resin Frame

Figure 2:
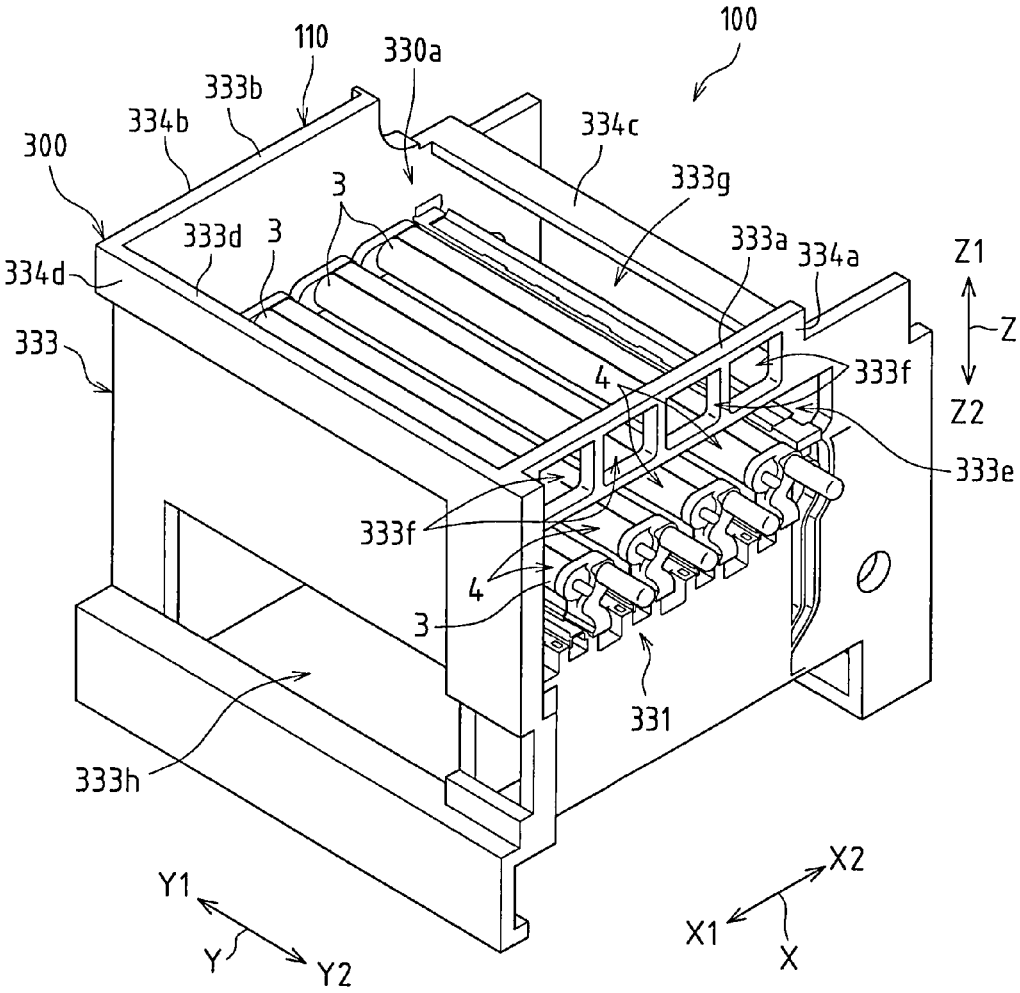
FIG. 2 is a schematic perspective view of a resin frame with a photosensitive member unit mounted thereto, of the image forming apparatus shown in FIG. 1, as seen obliquely from above the left front side.
Figure 3:
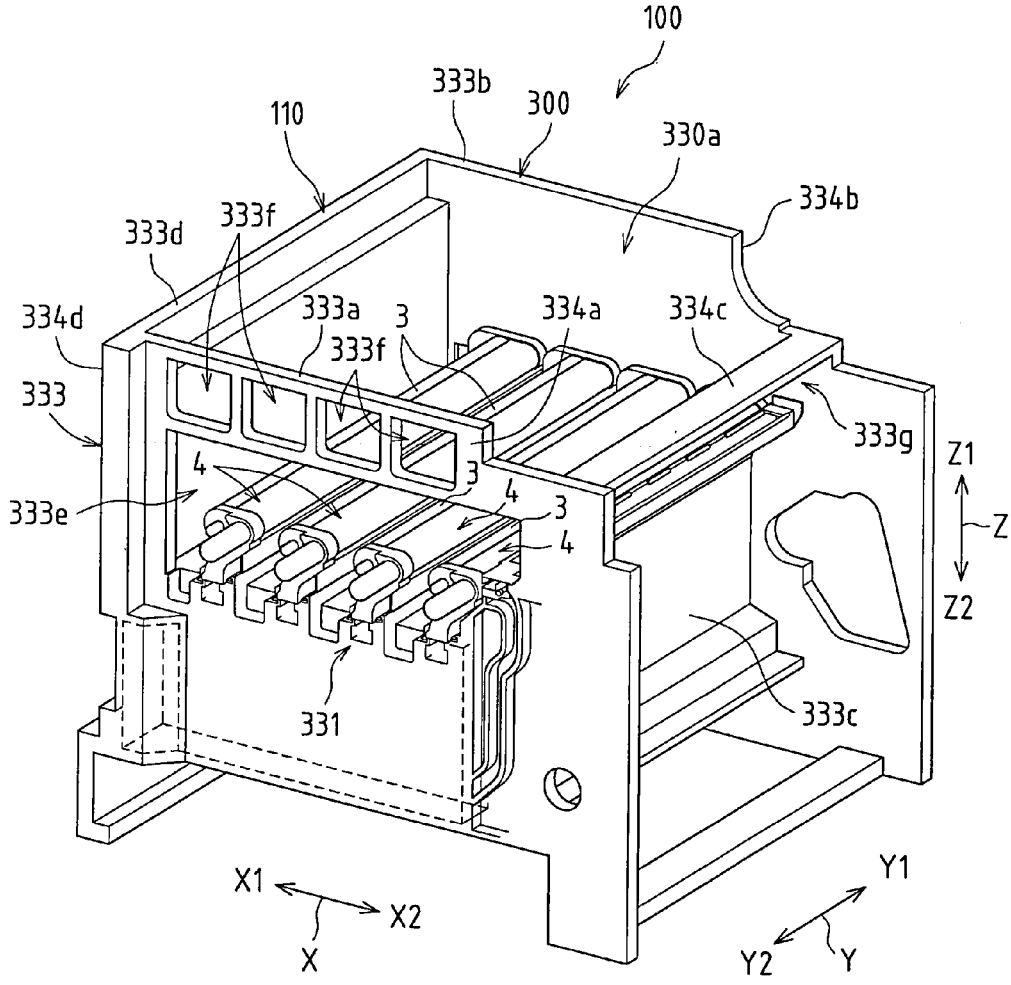
FIG. 3 is a schematic perspective view of the resin frame with the photosensitive member unit mounted thereto, of the image forming apparatus shown in FIG. 1, as seen obliquely from above the right front side.
Figure 4:
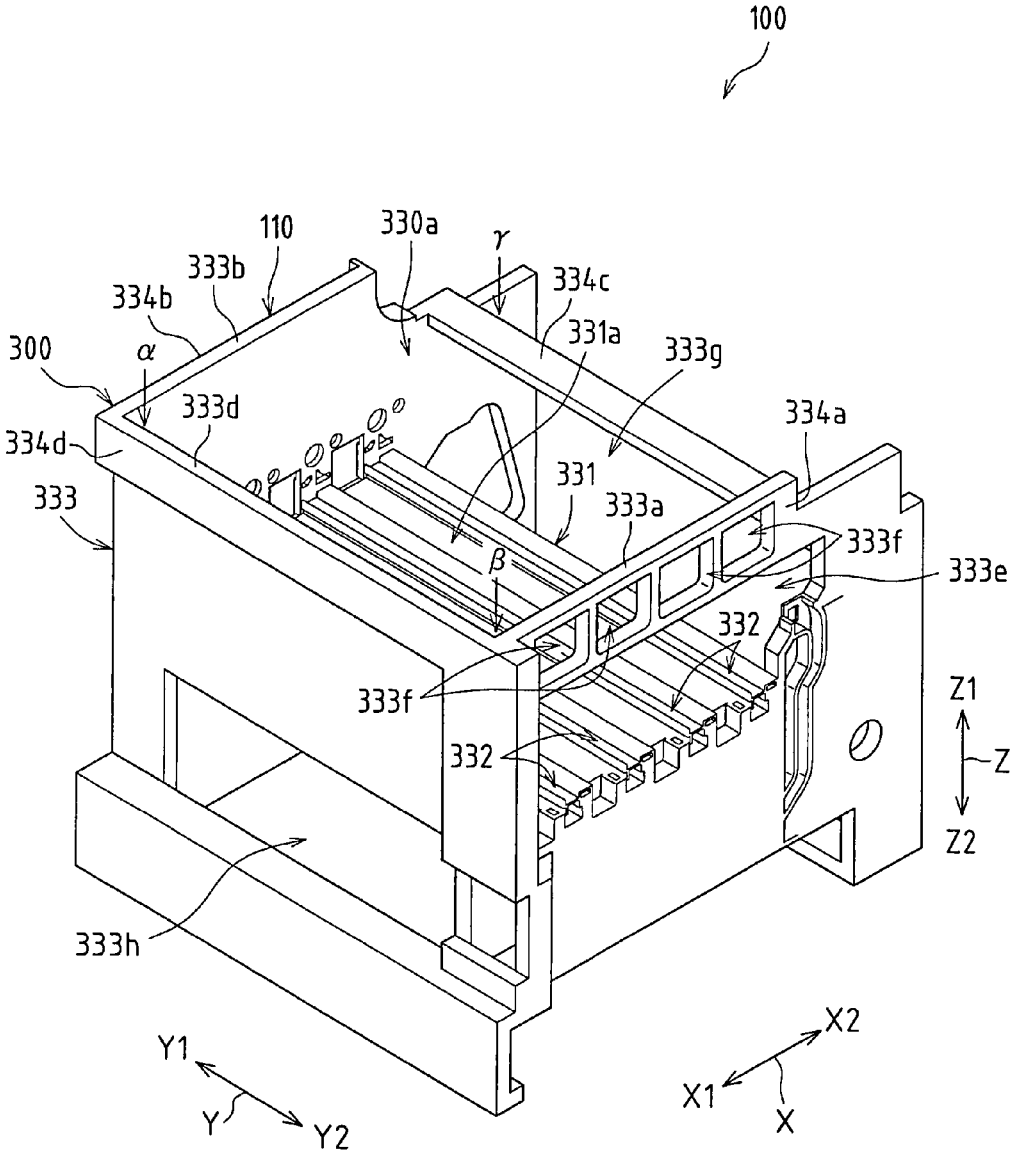
FIG. 4 is a schematic perspective view of the resin frame in FIGS. 2 and 3 in a state in which the photosensitive member unit has been removed, as seen obliquely from above the left front side.
Figure 5:
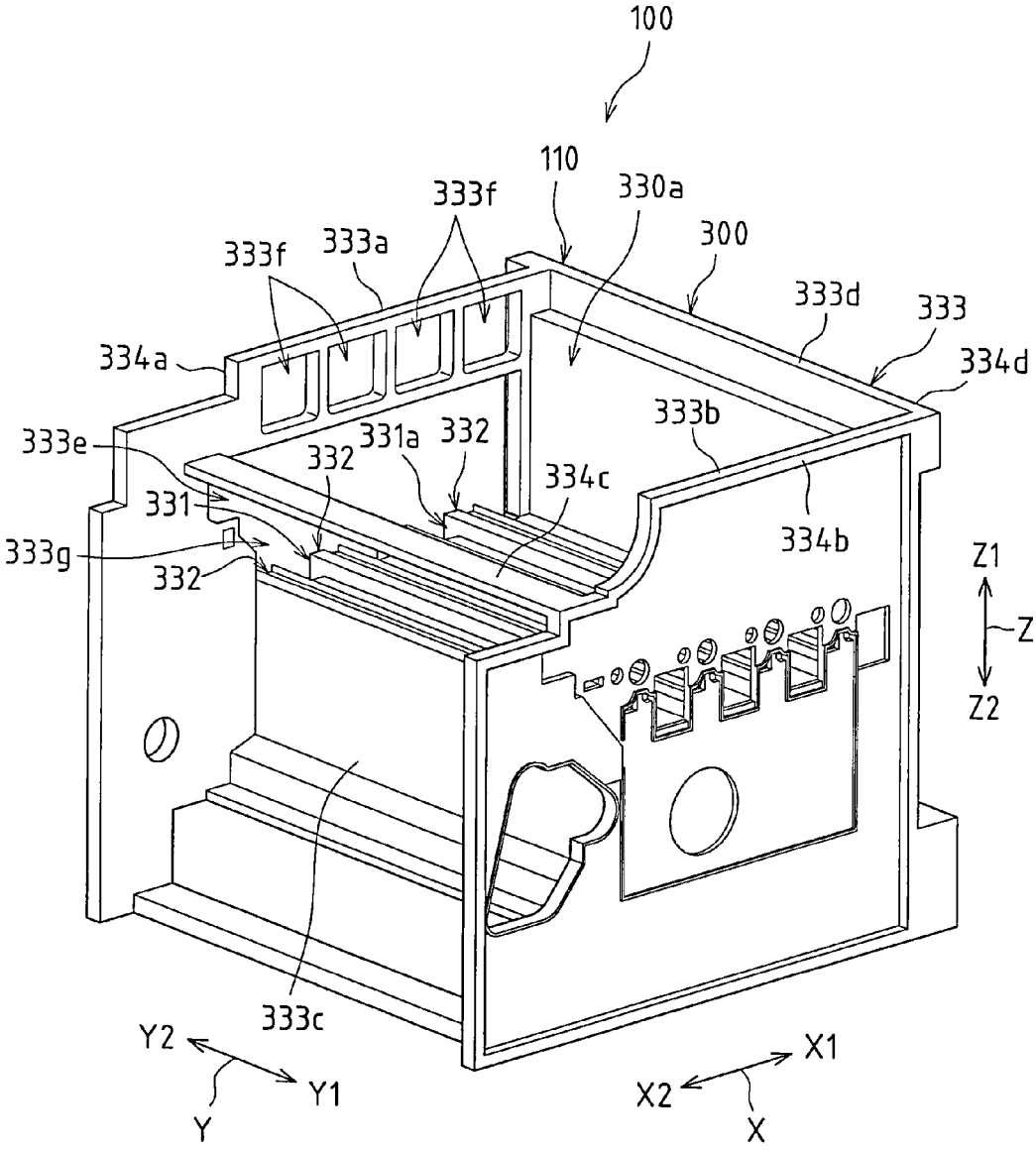
FIG. 5 is a schematic perspective view of the resin frame in FIGS. 2 and 3 in a state in which the photosensitive member unit has been removed, as seen obliquely from above the right back side.

FIGS. 2 and 3 are schematic perspective views of a resin frame 300 with the photosensitive member units 4 mounted thereto, of the image forming apparatus 100 shown in FIG. 1, as seen obliquely from above the left front side and as seen obliquely from above the right front side, respectively. Moreover, FIGS. 4 and 5 are schematic perspective views of the resin frame 300 in FIGS. 2 and 3 in a state in which the photosensitive member units 4 have been removed, as seen obliquely from above the left front side and as seen obliquely from above the right back side, respectively. Here, "left" and "right" are directions as seen when looking at the front of the apparatus main body 110. Moreover, in the drawings, arrow X indicates a width direction of the apparatus main body 110, arrow Y indicates a depth direction of the apparatus main body 110, and arrow Z indicates a vertical direction.

The image forming apparatus 100 according to the present embodiment further includes the resin frame 300 composed of a resin. The resin frame 300 is molded in one piece from a synthetic resin.

In the present embodiment, the photosensitive member units 4 are supported by the resin frame 300 and adapted to be inserted and removed in the depth direction Y in the apparatus main body 110. The resin frame 300 has a base 331, guide portions 332, and a side plate portion 333. The base 331 has a supporting surface 331*a* (see FIGS. 4 and 5) that supports at least one of the image forming units 200 (here, the photosensitive member units 4). The guide portions 332 extend in an insertion direction Y1 in which the photosensitive member units 4 are inserted into the apparatus main body 110 along the supporting surface 331*a* of the base 331, and the side plate portion 333 is provided at a peripheral edge of the base 331, extending in a direction perpendicular to the supporting surface 331*a*. More specifically, the guide portions 332 are adapted to guide the photosensitive member units 4 in the insertion direction Y1 while limiting the movement of the photosensitive member units 4 in orthogonal directions (directions including the width direction X and the vertical direction Z of the apparatus main body 110) orthogonal to the insertion direction Y1. The side plate portion 333 is formed from a first side plate portion 333*a* located on the front side of the apparatus main body 110, a second side plate portion 333*b* located on the back side of the apparatus main body 110, a third side plate portion 333*c* located on the right side of the apparatus main body 110, and a fourth side plate portion 333*d* located on the left side of the apparatus main body 110.

The plurality of development units 2 are adapted to be inserted and removed in the depth direction Y in the apparatus main body 110 with the photosensitive member units 4 interposed between each other in the width direction X of the apparatus main body 110 (see FIG. 1).

In the present embodiment, the photosensitive member units 4 and the development units 2 are configured as a plurality of units having a shape elongated in a direction (the depth direction Y of the apparatus main body 110) orthogonal to the first side plate portion 333*a* and the second side plate portion 333*b* between the first side plate portion 333*a* and the second side plate portion 333*b*. The plurality of photosensitive member units 4 and the plurality of development units 2 are alternately arranged in a row in an image forming direction (the moving direction of the intermediate transfer belt 61) M (see FIG. 1), here, the width direction X of the apparatus main body 110.

The first side plate portion 333*a* is provided with an opening 333*e* through which the plurality of development units 2 and the plurality of photosensitive member units 4 can be inserted and a plurality of openings 333*f* respectively corresponding to the plurality of toner cartridge units 21 and through which the toner cartridge units 21 can be inserted. The third side plate portion 333*c* is provided with an opening 333*g* through which one end portion (here, a right end portion) of the intermediate transfer belt unit 6 can project outward in the width direction X. Moreover, the fourth side plate portion 333*d* is provided with an opening 333*h* (see FIGS. 2 and 4) through which components of various types of electrical systems such as a control board can be installed.

The mold opening direction of a mold for molding the guide portions 332 is set to a direction (here, an upward direction Z1) parallel to an orthogonal direction orthogonal to the insertion direction Y1, and downstream end portions of the side plate portion 333 (here, the first to the fourth side plate portions 333*a* to 333*d*) in the mold opening direction (here, the upward direction Z1) are integrally connected to each other and extend essentially parallel to a perimeter of the base 331.

More specifically, a first connecting portion 334*a* extending in the width direction X of the apparatus main body 110 is provided in an upper end portion of the first side plate portion 333*a*. A second connecting portion 334*b* extending in the width direction X of the apparatus main body 110 is provided in an upper end portion of the second side plate portion 333*b*. A third connecting portion 334*c* extending in the depth direction Y of the apparatus main body 110 is provided in an upper end portion of the third side plate portion 333*c*. A fourth connecting portion 334*d* extending in the depth direction Y of the apparatus main body 110 is provided in an upper end portion of the fourth side plate portion 333*d*. End portions of the first to the fourth connecting portions 334*a* to 334*d* in their longitudinal direction are integrally connected to each other, and the connected first to fourth connecting portions 334*a* to 334*d* form an opening 330*a* at the top of the resin frame 300.

Figure 6B:
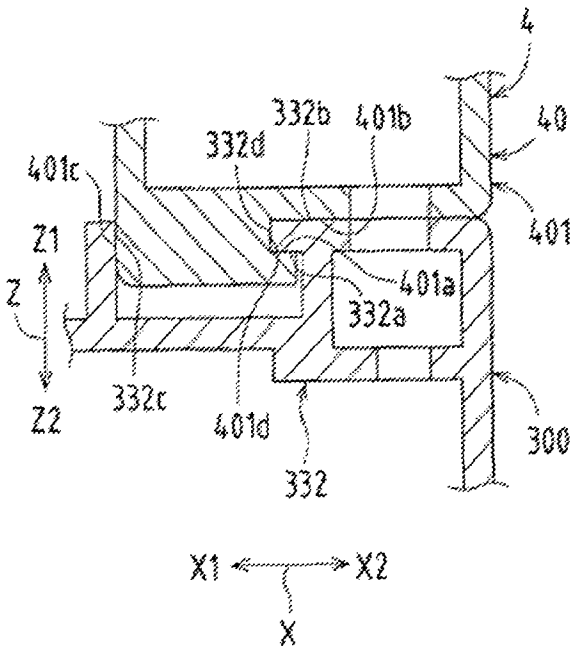
FIG. 6B is an enlarged cross-sectional view showing the portion of the guide portion in FIG. 6A in an enlarged manner.
Figure 6A:
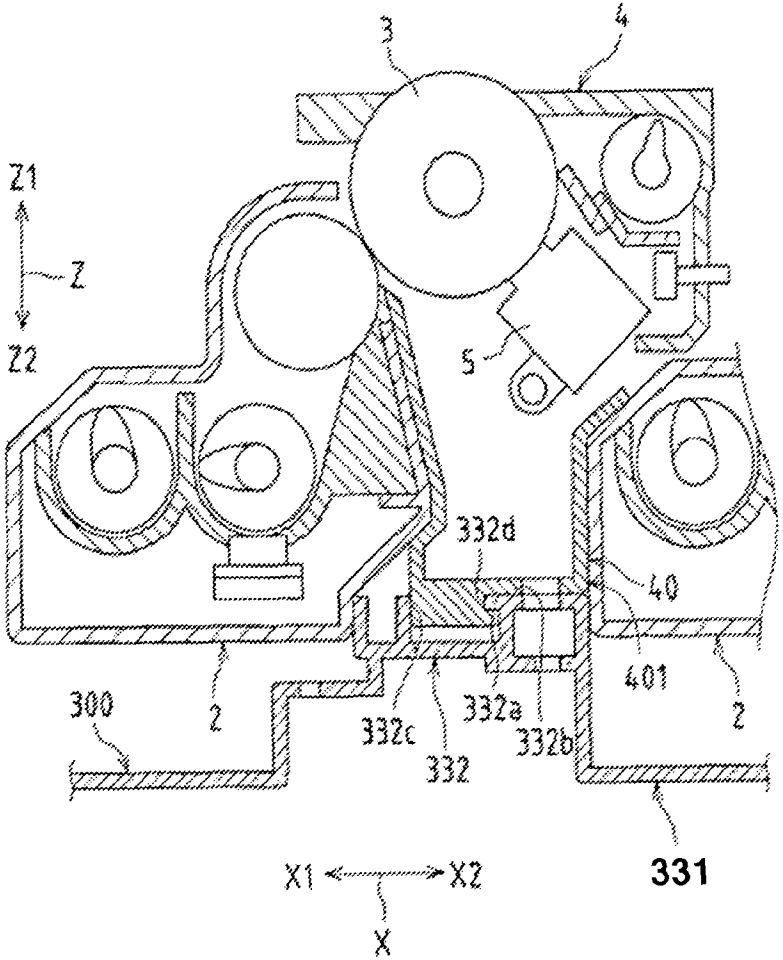
FIG. 6A is a schematic cross-sectional view schematically showing a portion of a guide portion in the photosensitive member unit mounted to the resin frame of the image forming apparatus shown in FIG. 1.

FIGS. 6A and 6B are diagrams illustrating the guide portions 332. FIG. 6A is a schematic cross-sectional view schematically showing a portion of the guide portions 332 in the photosensitive member units 4 in a mounted state in which the units are mounted to the resin frame 300 in the image forming apparatus 100 shown in FIG. 1. FIG. 6B is an enlarged cross-sectional view showing the portion of the guide portions 332 in FIG. 6A in an enlarged manner.

In the present embodiment, the guide portions 332 have a first limiting portion (a limiting surface) 332*a* that limits movement of a photosensitive member unit 4 in the upward direction Z1, a second limiting portion (a limiting surface) 332*b* that limits movement of the photosensitive member unit 4 in a downward direction Z2, a third limiting portion (a limiting surface) 332*c* that limits movement of the photosensitive member unit 4 in a left direction X1, and a fourth limiting portion (a limiting surface) 332*d* that limits movement of the photosensitive member unit 4 in a right direction X2. Specifically, the first limiting portion 332*a* to the fourth limiting portion 332*d* extend in the depth direction Y of the apparatus main body 110 and are adapted to come into sliding contact with a lower portion 401*a*, an upper portion 401*b*, a left portion 401*c*, and a right portion 401*d*, respectively, of lower case portions 401 of cases 40 of the photosensitive member units 4 during insertion and removal of the photosensitive member units 4 into and from the apparatus main body 110. Thus, it is possible to guide the photosensitive member units 4 in the insertion direction Y1 while limiting movement thereof in the width direction X and the vertical direction Z.

Figure 7:
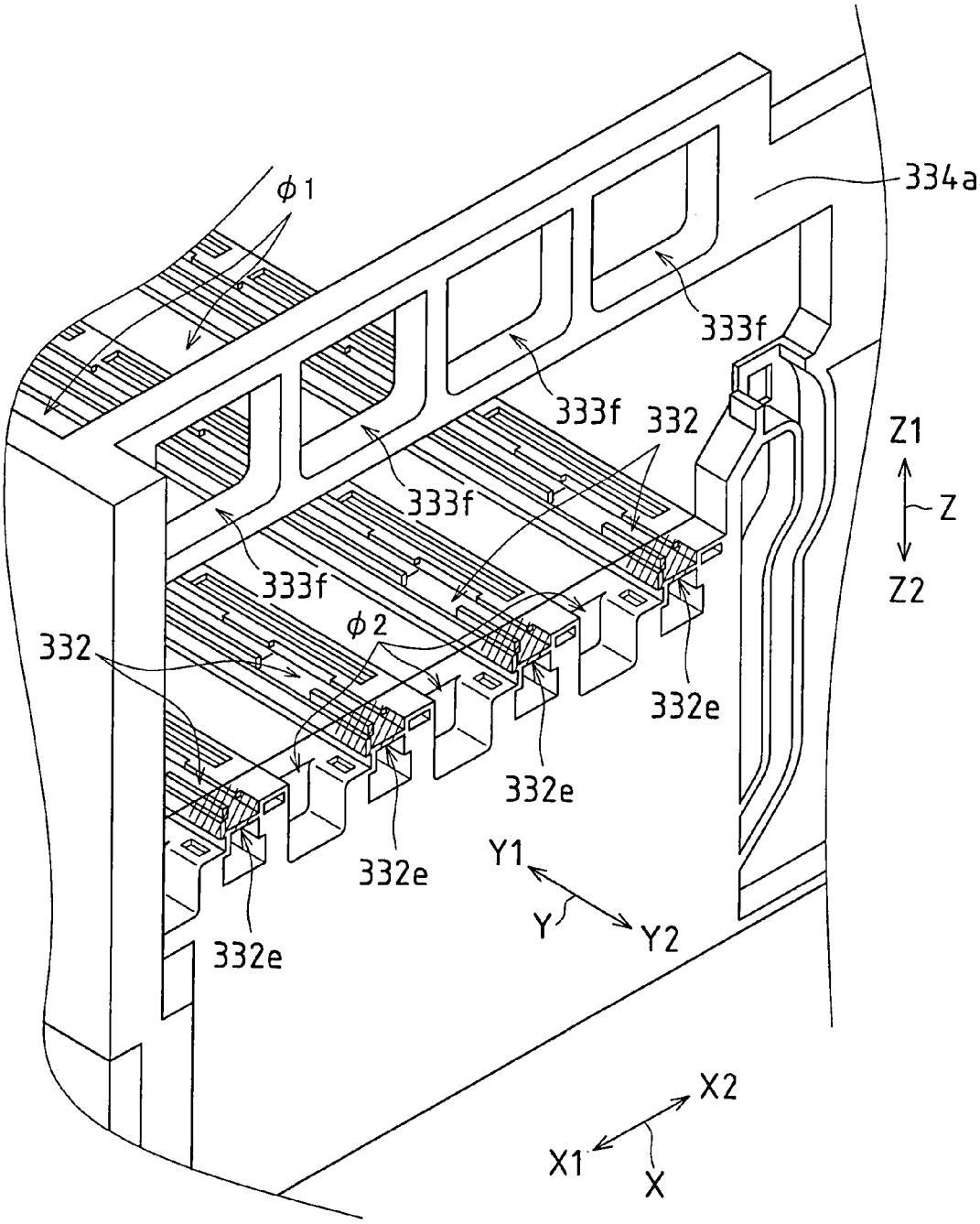
FIG. 7 is a schematic perspective view showing the guide portion of a base in FIG. 4 in an enlarged manner.

FIG. 7 is a schematic perspective view showing the guide portions 332 of the base 331 in FIG. 4 in an enlarged manner.

Incidentally, since the guide portions 332 are molded in the mold whose mold opening direction is set to the direction (here, the upward direction Z1) parallel to the orthogonal direction Z, it is difficult to mold the guide portions 332 below the first connecting portion 334*a* using this mold. Thus, in the present embodiment, as shown in FIG. 7, extended guide portions 332*e* (see hatched areas in FIG. 7) are integrally molded with the guide portions 332, extending further upstream (in an opposite direction Y2 to the insertion direction Y1) from an upstream end portion of the guide portions in the insertion direction Y1 in which the photosensitive member units 4 are inserted. The mold opening direction of a mold for molding the extended guide portions 332*e* is set to the direction Y (here, the opposite direction Y2 to the insertion direction Y1) parallel to the insertion direction Y1. It should be noted that peripheral portions (see ϕ1 in FIG. 7) that are integral with the guide portions 332 are also formed during molding of the guide portions 332. Similarly, peripheral portions (see ϕ2 in FIG. 7) that are integral with the extended guide portions 332*e* are also formed during molding of the extended guide portions 332*e*.

Figure 8A:
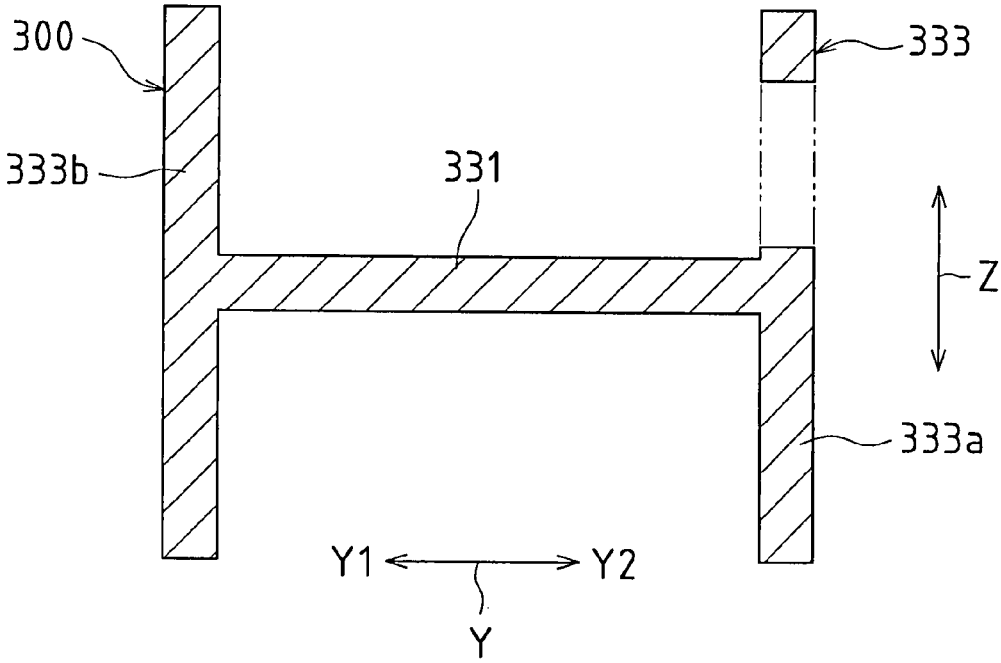
FIG. 8A is a schematic vertical cross-sectional view of the resin frame taken along a straight line passing through a position $\alpha$ and a position $\beta$ shown in FIG. 4.
Figure 8B:
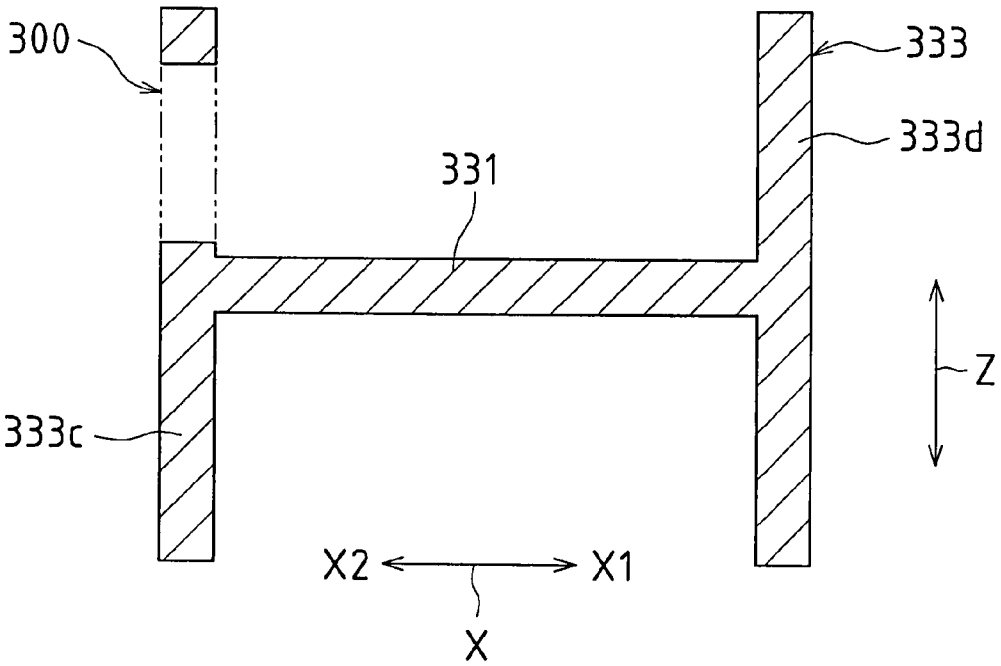
FIG. 8B is a schematic vertical cross-sectional view of the resin frame taken along a straight line passing through the position $\alpha$ and a position $\gamma$ shown in FIG. 4.

FIGS. 8A and 8B are cross-sectional views schematically showing the resin frame 300. FIG. 8A shows a schematic vertical cross-sectional view of the resin frame 300 taken along a straight line passing through a position α and a position β shown in FIG. 4, and FIG. 8B shows a schematic vertical cross-sectional view of the resin frame 300 taken along a straight line passing through the position α and a position γ shown in FIG. 4.

As shown in FIGS. 8A and 8B, in the present embodiment, the resin frame 300 is H-shaped (has an H shape) in cross section, in which the base 331 is provided perpendicular to the side plate portion 333 (here, the first to the fourth side plate portions 333*a* to 333*d*) between the upper end portion and the lower end portion of the resin frame in the vertical direction Z.

More specifically, the base 331 is in the form of a plate, and the plate-like base 331 (corresponding to the horizontal line of "H") is integrally connected to the first to the fourth side plate portions 333*a* to 333*d* (corresponding to the vertical lines of "H") at a substantially middle position in the vertical direction Z so as to extend in the horizontal direction. That is to say, the resin frame 300 has an H shape in cross section in the width direction X of the apparatus main body 110 shown in FIG. 8B as well as in cross section in the depth direction Y of the apparatus main body 110 shown in FIG. 8A.

Method for Molding the Resin Frame 300

Next, an example of a molding step of molding the resin frame 300 shown in FIGS. 2 to 8A and 8B from a resin will be described below with reference to FIG. 9.

In this molding step, the resin frame 300 can be injection molded from a resin using molds opposing each other on both sides in the vertical direction, in a front-and-back direction, and in a left-and-right direction.

Figure 9:
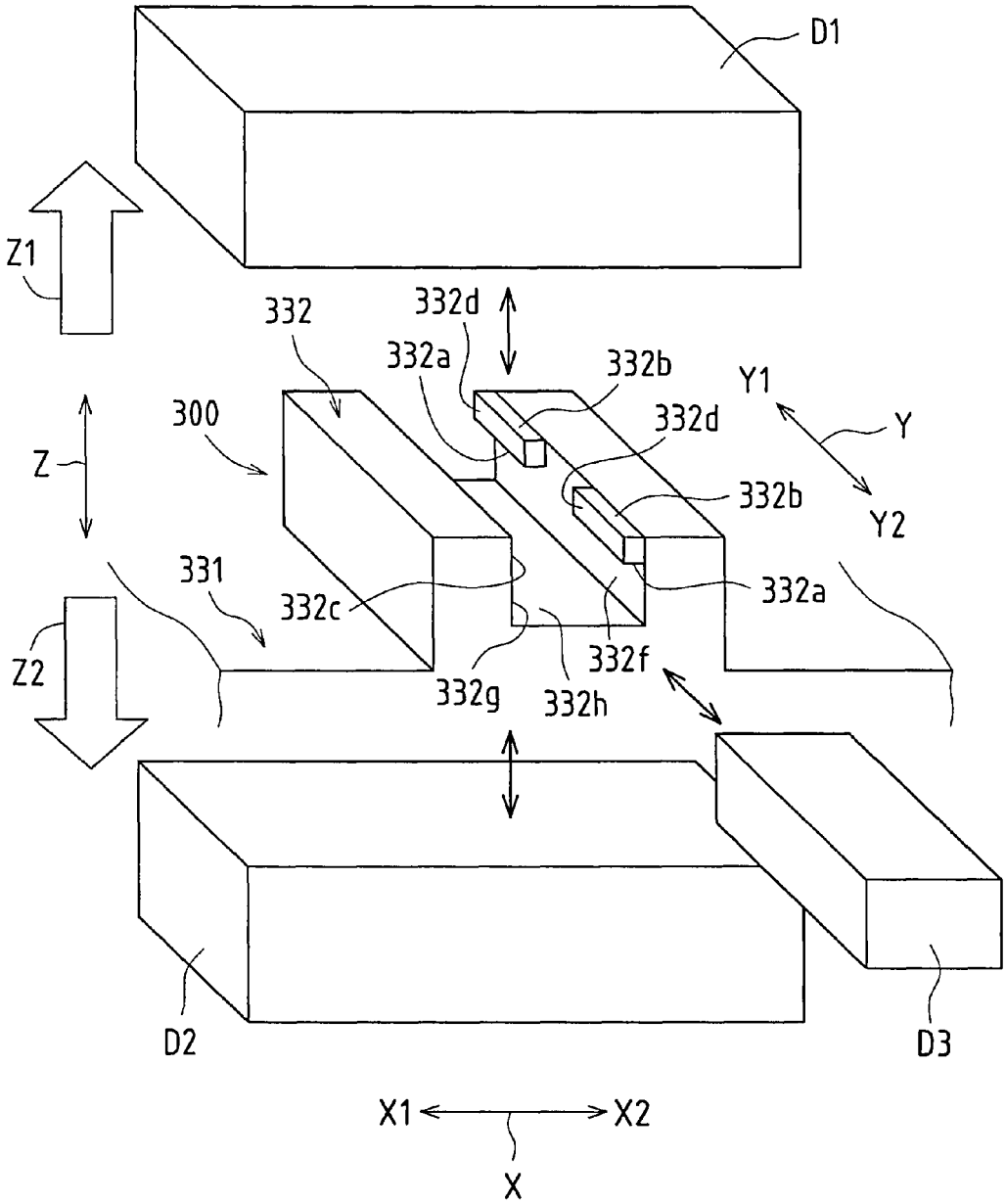
FIG. 9 is a schematic diagram for illustrating an example of a molding step of molding the resin frame shown in FIGS. 2 to 8A and 8B from a resin.
Figure 10:
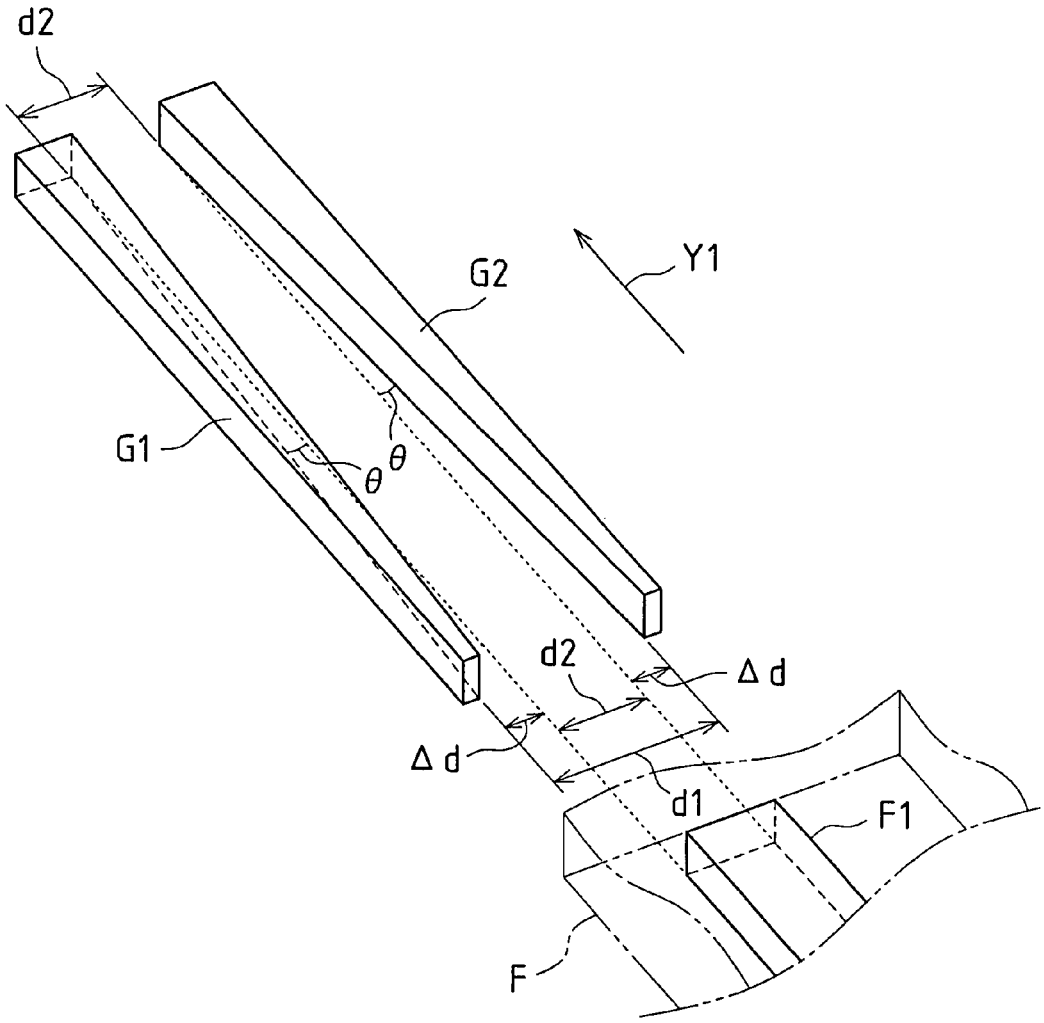
FIG.10 Prior Art
FIG. 10 is a perspective view showing a pair of rail portions formed by setting a mold opening direction of a mold to a direction parallel to an insertion direction in which an image forming unit is inserted.

FIG. 9 is a schematic diagram for illustrating an example of the molding step of molding the resin frame 300 shown in FIGS. 2 to 8A and 8B from a resin. It should be noted that FIG. 9 shows molds D1 and D2 opposing each other on both sides in the vertical direction Z. Moreover, FIG. 9 shows a portion of the guide portions 332 that have been molded in the mold D1 on the upper side (the Z1 side).

In the molding step shown in FIG. 9, the base 331, the guide portions 332, and the side plate portion 333 (not shown in FIG. 9) are integrally molded.

As for the mold D1 for molding the guide portions 332, the mold opening direction is set to a direction (here, the upward direction Z1) parallel to the orthogonal direction (here, the vertical direction Z) orthogonal to the insertion direction Y1, and this mold is adapted to form the first limiting portion 332*a*, the second limiting portion 332*b*, the third limiting portion 332*c*, and the fourth limiting portion 332*d*. Moreover, the mold D1 for molding the guide portions 332 has a structure in which during molding of the side plate portion 333 (see FIGS. 2 to 5), the downstream end portions (here, the first to the fourth connecting portions 334*a* to 334*d*) of the side plate portion 333 (here, the first to the fourth side plate portions 333*a* to 333*d*) in the mold opening direction (here, the upward direction Z1) are integrally connected to each other and extend essentially parallel to the perimeter of the base 331.

It should be noted that the mold opening direction of a mold D3 is set to the direction Y (here, the opposite direction Y2 to the insertion direction Y1) parallel to the insertion direction Y1. Specifically, the mold D3 is adapted to form faces (side faces 332*f* and 332*g* and a bottom face 332*h*) of the guide portions 332 below the first limiting portion 332*a*.

Moreover, although omitted from the drawings, the mold opening direction of a mold for molding the extended guide portions 332*e* also is set to the direction Y (here, the opposite direction Y2 to the insertion direction Y1) parallel to the insertion direction Y1.

As described above, according to the present embodiment, since the downstream end portions (here, the first to the fourth connecting portions 334*a* to 334*d*) of the side plate portion 333, which is provided at the peripheral edge of the base 331, extending in the direction Z perpendicular to the supporting surface 331*a*, in the mold opening direction (here, the upward direction Z1) are integrally connected to each other and extend essentially parallel to the perimeter of the base 331, the strength of the resin frame 300 can be secured. In addition, since the mold opening direction of the mold for molding the guide portions 332 is set to the direction (here, the upward direction Z1) parallel to the orthogonal direction Z orthogonal to the insertion direction Y1 and so the guide portions 332 are molded in the direction parallel to the orthogonal direction Z, the distance over which the mold slides with respect to the guide portions 332 can be reduced, and thus the structure of the mold can be simplified. Furthermore, since the mold opening direction of the mold for molding the guide portions 332 is set to the direction (here, the upward direction Z1) parallel to the orthogonal direction Z and the draft of the mold is unrelated to the direction parallel to the insertion direction Y1 in which the image forming units 200 (here, the photosensitive member units 4) are inserted, a decrease in the position accuracy of the photosensitive member units 4 in the orthogonal direction Z can be suppressed, the photosensitive member units 4 can be inserted smoothly, and thus a decrease in the ease of operation of the photosensitive member units 4 can be suppressed. It should be noted that concerning the draft in the direction (here, the upward direction Z1) parallel to the orthogonal direction Z, the slope of the third limiting portion 332*c* and the fourth limiting portion 332*d* can be set to 0° because the third limiting portion 332*c* and the fourth limiting portion 332*d* have a small width in the vertical direction Z. Moreover, even when the third limiting portion 332*c* and the fourth limiting portion 332*d* are sloped, since the mold slides only a small amount in the upward direction Z1, the slope can be set to about 1°, and in addition, since the third limiting portion 332*c* and the fourth limiting portion 332*d* have a small height in the vertical direction Z, a decrease in the position accuracy in the left-and-right directions X1 and X2 and a decrease in the ease of operation of the photosensitive member units 4 can be suppressed sufficiently.

According to the present embodiment, portions (here, portions below the first connecting portion 334*a*) of the guide portions 332 in the base 331 that are difficult to mold using the mold whose mold opening direction is set to the direction (here, the upward direction Z1) parallel to the orthogonal direction Z can be molded as the extended guide portions 332*e* using the mold whose mold opening direction is set to the direction (here, the opposite direction Y2 to the insertion direction Y1) parallel to the insertion direction Y1.

Moreover, according to the present embodiment, as shown in FIGS. 8A and 8B, the resin frame 300 is formed into an H shape, which provides excellent rigidity while realizing an improvement in the section efficiency ([section modulus]/[cross-sectional area], for example), and this makes it possible to improve the overall strength of the resin frame 300 with a simple structure and, furthermore, to provide the base 331, which supports the photosensitive member units 4, in a position between the upper end portion and the lower end portion of the frame in the vertical direction Z at which the strength is increased.

Moreover, according to the present embodiment, among the photosensitive member units 4 including the photosensitive member's units and the charging units and the development units 2 whose position accuracy is likely to influence the image quality, a decrease in the position accuracy of units (here, the photosensitive member units 4) supported by the base 331 can be suppressed, and the image quality can be improved accordingly.

Moreover, according to the present embodiment, since the image forming units 200 are color image forming units, a decrease in the position accuracy of the color image forming units can be suppressed, and the color image quality can be improved accordingly.

The present invention can be carried out in various other forms without departing from the spirit and essential characteristics thereof. Therefore, the embodiment described above is to be considered in all respects as illustrative only, and not as being restrictive. The scope of the present invention is defined by the appended claims and should not be restricted to the description hereinabove. Furthermore, all modifications and changes which come within the meaning of equivalency of the claims are intended to be embraced by the scope of the present invention.

What is claimed is:

1. A color image forming apparatus comprising a resin frame composed of a resin and a plurality of image forming units that are removably inserted in the resin frame, wherein the resin frame comprises:

a base having a supporting surface that supports the plurality of image forming units;

guide portions that extend in the base in an insertion direction in which the image forming units are inserted along the supporting surface and that guide the image forming units in the insertion direction while limiting movement of the image forming units in an orthogonal direction that is orthogonal to the insertion direction;

side plate portions that are provided at respective peripheral edges of the base so as to extend in a direction perpendicular to the supporting surface; and connecting portions that are each provided either in an upper end portion of a respective side plate portion or above a different one of the side plate portions so that the connecting portions are parallel to the respective peripheral edges of the base, the base, the guide portions, the side plate portions and the connecting portions being integrally formed from a resin; and end portions of the connecting portions in their longitudinal direction being integrally connected to each other, the connecting portions integrally connected to each other to form an opening to open above the base.

2. The image forming apparatus according to claim 1, wherein extended guide portions extending further upstream from upstream end portions of the guide portions in the insertion direction in which the image forming units are inserted is integrally molded with the guide portions, and the mold opening direction of a mold for molding the extended guide portions is set to a direction parallel to the insertion direction.

3. The image forming apparatus according to claim 2, wherein the resin frame is H-shaped in cross section with the base provided between an upper end portion and a lower end portion of the resin frame in a vertical direction and perpendicular to the side plate portion.

4. The image forming apparatus according to claim 1, wherein the resin frame is H-shaped in cross section with the base provided between an upper end portion and a lower end portion of the resin frame in a vertical direction and perpendicular to the side plate portions.

5. The image forming apparatus according to claim 1, wherein each of the image forming units comprises a photosensitive member's unit, a charging unit, and a development unit.

6. The image forming apparatus according to claim 5, wherein each of the image forming units is a unit into which at least two of the photosensitive member's unit, the charging unit, a cleaning unit, and the development unit are combined.

7. The image forming apparatus according to claim 6, wherein the unit into which at least two of the units are combined is formed as an integral unit.

8. The image forming apparatus according to claim 1, wherein at least one of the image forming units is a color image forming unit.

9. A resin frame molding method for molding a frame of an image forming apparatus comprising a plurality of image forming units that are removably inserted in the frame from a resin, the method comprising a molding step of integrally molding:

a base having a supporting surface that supports the plurality of image forming units;

guide portions that extend in the base in an insertion direction in which the image forming units are inserted along the supporting surface and that guide the image forming units in the insertion direction while limiting movement of the image forming units in an orthogonal direction that is orthogonal to the insertion direction;

side plate portions that are provided at respective peripheral edges of the base so as to extend in a direction perpendicular to the supporting surface; and connecting portions that are each provided either in an upper end portion of a respective side plate portion or above a different one of the side plate portions so that the connecting portions are parallel to the respective peripheral edges of the base, wherein in the molding step, a mold opening direction of a mold for molding the guide portions is set to a direction parallel to the orthogonal direction, and during molding of the connecting portions, end portions of the connecting portions in their longitudinal direction are integrally connected to each other, the connecting portions integrally connected to each other to form an opening to open above the base.

10. The resin frame molding method according to claim 9, wherein in the molding step, the guide portions and extended guide portions extending further upstream from upstream end portions of the guide portions in the insertion direction in which the image forming units are inserted are integrally molded, and the mold opening direction of a mold for molding the extended guide portions is set to a direction parallel to the insertion direction.

11. The resin frame molding method according to claim 9, wherein in the molding step, a resin frame that is H-shaped in cross section with the base provided between an upper end portion and a lower end portion of the resin frame and perpendicular to the side plate portions is molded.

* * * * *